US005467907A

United States Patent [19]

Celik

[11] Patent Number: 5,467,907

[45] Date of Patent: Nov. 21, 1995

[54] TURKEY TOTE

[76] Inventor: Richard J. Celik, R.R. #2 Box 259 Arch Bridge Rd., Ghent, N.Y. 12075

[21] Appl. No.: 848,917

[22] Filed: Mar. 10, 1992

[51] Int. Cl.[6] ..... A45F 3/04; B65D 30/08

[52] U.S. Cl. ..... 224/103; 224/148; 224/209; 224/215; 224/259; 224/260; 224/921; 383/113; 383/117

[58] Field of Search ..... 224/103, 202, 224/148, 204, 209, 215, 235, 257, 259, 260, 921; 383/109, 117, 113

[56] References Cited

U.S. PATENT DOCUMENTS

| | | | |
|---|---|---|---|
| 749,661 | 1/1904 | Clarke | 224/209 |
| 1,725,864 | 8/1929 | James | 383/117 X |
| 2,323,318 | 7/1943 | Farkas | 383/117 X |
| 2,407,787 | 9/1946 | Kernahan | 224/209 |
| 2,682,290 | 6/1954 | Ditlea | 383/117 X |
| 2,710,639 | 6/1955 | Farls | 383/113 X |
| 3,674,188 | 7/1972 | Anderson | 224/921 X |
| 4,096,978 | 6/1978 | Noice | 224/215 |
| 4,156,446 | 5/1979 | Nathan | 383/117 X |
| 4,213,549 | 7/1980 | Hibbard | 224/209 |
| 4,364,425 | 12/1982 | Mainville | 383/113 X |
| 4,420,103 | 12/1983 | Douglass | 224/210 |
| 4,648,121 | 3/1987 | Lowe | 224/209 X |
| 4,673,117 | 6/1987 | Calton | 224/151 |
| 4,941,603 | 7/1990 | Creamer et al. | 224/148 |
| 4,949,842 | 8/1990 | Mokiao, II | 383/117 X |
| 4,989,995 | 2/1991 | Rubenstein et al. | 383/117 |

FOREIGN PATENT DOCUMENTS

| | | | |
|---|---|---|---|
| 3162246 | 12/1991 | Japan | 383/113 |

*Primary Examiner*—Allan N. Shoap
*Assistant Examiner*—Vanessa Caretto
*Attorney, Agent, or Firm*—Carl C. Kling

[57] ABSTRACT

The invention is a hunter's personal safety game pack and method of making it. The game pack is especially designed for the wild turkey, with a bloodproof bottom pouch, a No-See-Um mesh drawstring bag top, and a shoulder harness. The wild turkey is a large bulky bird, weighing approximately 10 kilograms. It is cumbersome and messy, a burden to carry without a game pack. Carrying a wild turkey using one hand in the traditional over-shoulder position puts the hunter in a very dangerous situation. Carrying his gun with one hand is not recommended for safe gun handling; the exposed turkey on his back invites other hunters to shoot at the turkey and possibly shoot the otherwise successful turkey hunter in the back or head. Perhaps even more important, Lyme ticks may be transferred from turkey to hunter, with risk of the disabling and sometimes fatal Lyme disease. The taken turkey must cool quickly to avoid spoilage. The No-See-Um mesh top permits cooling ventilation without permitting any ticks to pass. The game pack thus solves the multiple problems of anti-spoilage cooling, anti-tick barrier, ease of carrying the weight, fluid barrier, and hiding the turkey from other hunters to prevent accidents. The game pack is made in three panels, two mesh and one bloodproof, sewn together with suspension system and drawstring for completeness, effectiveness and easy cleaning.

8 Claims, 2 Drawing Sheets

TURKEY TOTE

BACKGROUND OF THE INVENTION

1. Field of the Invention

This invention relates to game packs, and more particularly relates to a Turkey Tote, a specialized carrier for a wild turkey taken by a hunter.

2. Description of Related Art

There are a number of generalized game bags for hunters, ranging from a simple bag to a backpack. There are some specialized game packs for hunters, including a game bag with a shoulder strap.

There is no previously known game pack specialized for the wild turkey which presents a number of problems. Chief among the problems presented by the wild turkey are the following:

1. The turkey may weight 15–25 pounds, and quickly gets very heavy to carry.

2. The turkey may be bloody or messy.

3. The turkey must cool rapidly to avoid spoiling.

4. The turkey must be placed out of sight so as not to remain a target for other hunters. If allowed to remain totally exposed, the taken wild turkey places the hunter, himself, in an unsafe position. Another hunter, seeing a wild turkey flapping and moving, could shoot at that wild turkey being carried on the hunter's back, causing injury or even death to the successful hunter.

Hunters generally, and certainly hunters in the wet north woods, are unpleasantly familiar with the tiny biting flies which swarm from time to time. Sometimes called black flies, sometimes called punkie flies, but most often referred to non-specifically as "no-see-ums," these tiny flies, though hard to see, are terrible pests. Webster's Second Edition Unabridged defines them as follows:

> no-see'-um . . . [That is, you don't see'em; English of American Indians.] A punkie (fly). Collog.

One solution to the no-see-um is a bug repellant; another is a sort of fine-mesh veil, similar to mosquito netting for the much larger mosquito. Such a veil, made of very fine mesh, called "no-see-um mesh" for its capacity to interdict the ubiquitous and nasty "no-see-um," is itself quite visible and is available to hunters in shades of green color. "No-see-um mesh" is a colloquial descriptive term for very fine mesh, not a trademark. Like any veil, the fine mesh can partially obscure the features of a person veiled by it, but it is not primarily for concealment. It's to keep off the no-see-ums.

"No-see-um" mesh, the inventor has found, also can serve as a tick-interdicting airflow mesh, to block the deer tick, a common tick in the northeastern United States. The deer tick, although most easily found on deer because of the large size of the deer, also infest mice, birds—and mankind. They carry the spirochete of a serious infection, first diagnosed in Old Lyme, Conn., and therefore tagged "Lyme Disease."

A representative "no-see-um" mesh is Government CFI 84 flame retardant approved, 100% Nylon (TM) 20 denier, having a wale count of 32×23 per inch (approximately 13×9 per centimeter).

5. The turkey may be infested with ticks and thus be a danger to the hunter in transmitting Lyme Disease, Rocky Mountain Spotted Fever, or other potentially disabling or deadly disease. The turkey, as it cools, becomes less attractive to ticks who may prefer to transfer onto the hunter.

6. The turkey is bulky and has significant wing and tail feathers which make it awkward and difficult to carry.

7. Having to carry the taken wild turkey with one hand, this leaves only one hand to carry the gun; posing an unsafe gun handling condition.

It is clear that, as the number of wild turkey increases and the sport of hunting wild turkey increases in popularity, there is a need for a game pack which solves the seven problems listed above.

SUMMARY OF THE INVENTION

It is the object of the invention to provide an elegant and useful Turkey Tote, which solves the seven problems above, providing a convenient and safe mechanism for comfortably carrying the taken wild turkey out of the field.

Another object of the invention is the economy of initial cost and of carry weight, coupled with camouflage capability.

A feature of the invention is its combination of blood-capturing bottom pouch, tick-confining top section, and its unique suspension system.

Another feature of the invention is the use of two different colors of green fabric which break up a sold and form a camouflage effect which serve to make the hunter, and the taken turkey, less visible to other hunters.

An advantage of the invention is its elegant simplicity, and its ability to be folded into a compact, lightweight, packet of pocket size, for carrying into the field, ready for use when a wild turkey is taken.

Another advantage is its ability to hide the taken wild turkey, so other hunters will not be tempted to shoot at that wild turkey, while being carried.

Another advantage is the combination of easy airflow with confinement of any ticks, which permits the wild turkey to cool rapidly without escape by the ticks.

Another advantage is that the taken wild turkey is securely bagged for an easy, comfortable and safe carry, utilizing the suspension system with its unique custom fit sternum strap which permits a secure hands-free backpack.

Another advantage is the ease of washing, in preparation for a subsequent use.

Other objects, features and advantages of the invention will be apparent from the following specification and from the annexed drawings and claims.

DETAILED DESCRIPTION OF THE PREFERRED EMBODIMENT

Figure 1:
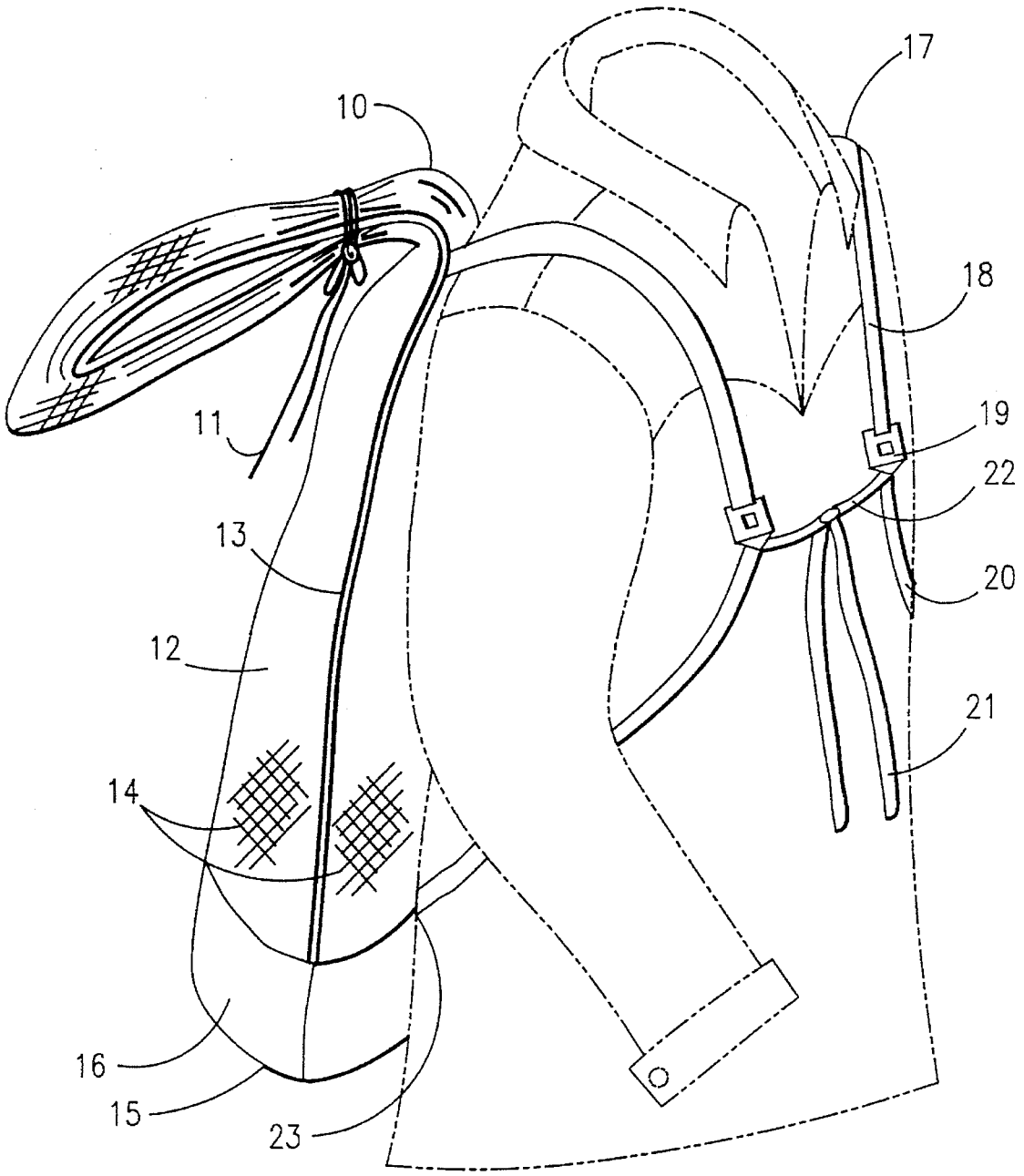
FIG. 1 is a perspective view of the turkey tote in use.

FIG. 1 shows the Turkey Tote in use.

Referring now more specifically to the drawings, reference numeral 10 is used to generally designate the Turkey Tote game pack which comprises the invention; while reference numerals 11–16 generally designate the construction details; and reference numeral 17 is used to generally designate the suspension system comprising of the shoulder straps 18, adjusting buckles 19, bottom straps 20, bottom strap ends 21, custom fit sternum strap 22, and bottom strap attachments 23.

With the use of the Turkey Tote 10, a taken wild turkey once placed in the Turkey Tote 10 becomes totally enclosed, concealed and sealed within the Turkey Tote 10 by means of a draw string tie cord closure 11 at the top of the bag. The top section or main body 12 of the bag is made of an olive color, double stitched, reinforced 13 heavy duty, super fine, nylon polyester No-See-Um mesh netting 14, the function of which allows the taken wild turkey's body heat to rapidly cool down, helping to prevent spoiling of the meat, while confining Lyme Ticks and the like insects, within the Turkey Tote 10. This keeps them from transferring onto the body of the user, helping to prevent contracting Lyme Disease. The bottom section 15 of the bag is made of a green color, coated nylon, sheet material 16, its function being to carry the bulk of the weight of the wild turkey and to help keep blood from the head of the wild turkey from getting on the user. The color of the materials of the Turkey Tote 10 olive and green, camouflage and totally conceal the taken wild turkey from human view, which significantly reduces the risk to the user from being shot in the back or head by another turkey hunter, while transporting the taken wild turkey.

The suspension system 17, once attached to the bag, now forms a pack. The pack is totally made of polyester materials, so nothing can rust if caught out in the rain, and may be conveniently washed out with a hose, or placed in a washing machine, if so desired. The function of the suspension system 17 is to comfortably and evenly displace the weight of the taken wild turkey within the Turkey Tote 10, while being safely carried by the user.

Figure 2:
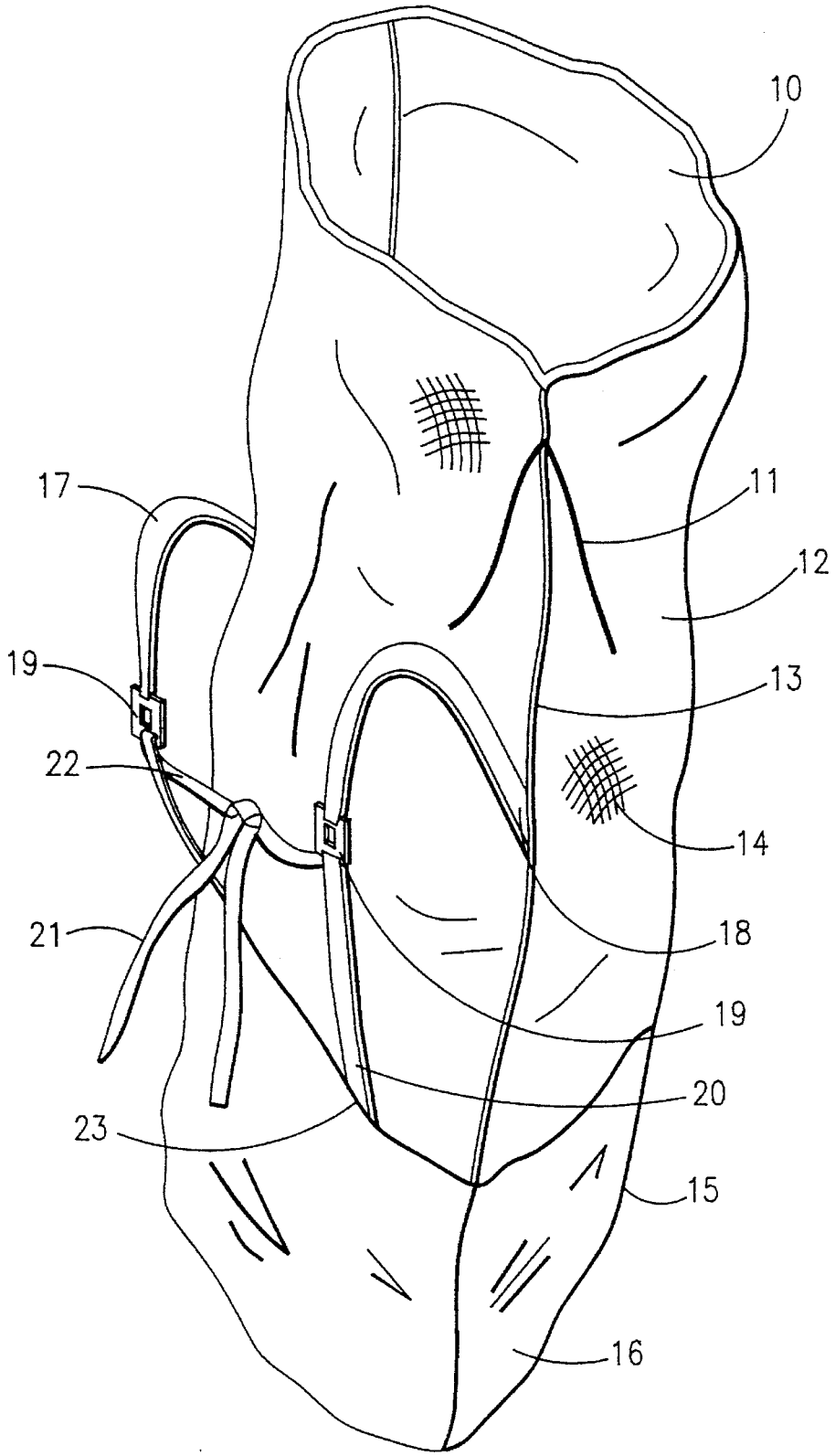
FIG. 2 is a rear perspective view of the turkey tote empty.

FIG. 2 shows the Turkey Tote construction.

The suspension system 17 comprising of black, 37.5 mm wide shoulder straps 18, one end being sewn into the reinforced side seams 13 at prescribed locations, with the other end retaining the polyester adjusting buckles 19; and one end of the black, 25 mm wide bottom straps 20, sewn into the seam junction 23 of the top and bottom sections of the Turkey Tote 10 at prescribed locations, the other ends to be engaged by the adjusting buckles 19 to form part of the suspension system 17. Once adjusted for a snug fit on the user, the excess bottom strap ends 21 are tied across the chest of the user, forming a custom fit sternum strap 22, completing the total suspension system 17. The suspension system 17 totally secures the Turkey Tote 10 to the user, for a safe, comfortable carry out of the woods. Significantly reducing the hazardous dangers of otherwise carrying a taken wild turkey with one hand, totally exposed, hanging at the turkey hunters back.

When not in use, the Turkey Tote 10 when folded, is small and light enough to be carried in the users pants pocket.

OPERATION

FIG. 1 shows the Turkey Tote 10 game pack with a wild turkey inside, tail up. The No-See-Um mesh netting 14 of the main body 12 is tightly tied by the draw string tie cord closure 11 to confine any ticks which might be present on the wild turkey. The excess netting is then folded over and tied again to form a double seal.

Airflow through the No-See-Um mesh netting 14 allows quick cooling of the wild turkey. Any blood is captured by the waterproof fabric 16 in the bottom section 15. The hunter ties the sternum strap 22 for a comfortable custom fit.

After use, the entire Turkey Tote 10 game pack, after the taken wild turkey is removed, may be washed by the use of a water hose or by placing in a washing machine, and dried by shaking it several times in the air or hanging on a line, in preparation for use at another time.

METHOD

The method of making the Turkey Tote game pack comprises the following steps:

1.) providing back piece, front piece and bottom piece, each substantially rectangular, back piece and front piece being of mesh cloth and bottom piece being of waterproof fabric:

2.) providing first and second bottom suspension straps and first and second shoulder suspension straps;

3.) providing draw string tie cord closure;

4.) providing first and second buckles;

5.) sewing the first and second buckles to one end of the first and second shoulder suspension system straps;

6.) sewing the back piece and the bottom piece with the first and second bottom suspension straps at notched locations.

7.) sewing the front piece and the bottom piece;

8.) folding the bottom piece to form a pouch, inside out, and the top section, also inside out, keeping the bottom suspension straps between the two layers of material;

9.) sewing a first side seam; from the folded bottom piece, extending up along the bottom section and continuing up into the top section to the first shoulder suspension strap notch location. Placing the first shoulder suspension strap in between the front and back top sections and at the notch location on the seam, continue to sew up across the distal end of the first shoulder strap to include the strap inside the seam, finishing the seam at the top of the top section.

10.) sewing a second side seam; from the folded bottom piece, extending up along the bottom section and continuing up into the top section to the second shoulder suspension strap notch location. Placing the second shoulder suspension strap in between the front and back top sections at the notch location on the seam, continue to sew up across the distal end of the second shoulder suspension strap to include the strap inside the seam, finishing the seam at the top of the top section.

11.) sewing the draw string tie cord closure into the top hem.

While the invention has been shown preferably in the form of a Turkey Tote of a preferred design, it will be clear to those skilled in the art that the modifications described as alternatives, plus other alternatives, may be pursued without departing from the spirit and scope of the invention, as defined in the following claims:

What is claimed is:

1. A hunter's personal safety gamepack comprising:

a) waterproof bottom section (16);

b) top section (12), made up of tick-interdicting mesh, securely fastened to bottom section (16);

c) closure means (11), arranged for selective closure of said top section (12); and d) suspension system (17–23) securely affixed to said bottom section (16) and said top section (12);

whereby a substantial quantity of game may be safely carried without hands and without transfer of game body fluids or tick infestation from game to hunter in a vessel which affords concealment of its contents, providing personal safety to the hunter.

2. A hunter's personal safety gamepack according to claim 1, for wild turkey transport, wherein said waterproof bottom section (16) is of polyester sheet, and said top section (12) is of very close tick-interdicting mesh.

3. A hunter's personal safety gamepack according to claim 2, for wild turkey transport, wherein said top section (12) is of length sufficient to accommodate a large wild turkey and still have sufficient excess length for folding over for a foldover tight closure by closure means (11).

4. A hunter's personal safety gamepack according to claim 3, for wild turkey transport, wherein said closure means is a permanently attached drawstring set (11).

5. A hunter's personal safety gamepack according to claim 4, for wild turkey transport, wherein said suspension system is a permanently attached set of shoulder straps of length sufficient to serve as both shoulder straps and custom fit sternum tie straps.

6. A hunter's personal safety gamepack according to claim 3, wherein said top section (12) and said bottom section (16) are of two different shades of green, affording a camouflage effect.

7. A hunter's personal safety gamepack according to claim 6, wherein said top section (12) is olive colored and said bottom section (16) is green colored, making up a camouflage effect obscuring any taken wild turkey from visual observation by other hunters.

8. A hunter's personal safety gamepack, made according to the following steps:

a.) providing back piece, front piece and bottom piece, each substantially rectangular;

b.) providing first and second bottom suspension straps and first and second shoulder suspension straps;

c.) providing draw string tie cord closure;

d.) providing first and second buckles;

e.) sewing said first and said second buckles to one end of said first and said second shoulder suspension system straps;

f.) sewing said back piece and said bottom piece with said first and said second bottom suspension straps at notched locations;

g.) sewing together said front piece and said bottom piece;

h.) folding said bottom piece to form a pouch, inside out, and said top section, also inside out, keeping said bottom suspension straps between said two layers of material;

i.) sewing a first side seam, from said folded bottom piece, extending up along said bottom section, continuing up into said top section to said first shoulder suspension strap notch location, placing said second shoulder suspension strap in between said front and said back top sections and at the notch location on said seam, continuing to sew up across the distal end of said first shoulder suspension strap to include said strap end inside said seam, finishing said seam at the top of said top section;

j.) sewing a second side seam, from said folded bottom piece, extending up along said bottom section, continuing up into said top section to said second shoulder suspension strap notch location, placing said second shoulder suspension strap in between said front and back top sections at the notch location on said seam, continuing to sew up across the distal end of said second shoulder suspension strap to include said strap and inside said seam, finishing said seam at the top of the top section;

k.) sewing said drawstring tie closure into said top hem.

* * * * *